US005460152A

United States Patent [19]

Specht

[11] Patent Number: 5,460,152

[45] Date of Patent: Oct. 24, 1995

[54] ADJUSTABLE THREE-POINT ARROW REST FOR A COMPOUND ARCHERY BOW

[76] Inventor: John J. Specht, 23 Melrose Rd., Bristol, R.I. 02809

[21] Appl. No.: 208,706

[22] Filed: Mar. 11, 1994

[51] Int. Cl.[6] ..... F41B 5/22

[52] U.S. Cl. ..... 124/44.5

[58] Field of Search ..... 124/23.1, 24.1, 124/44.5, 86, 88

[56] References Cited

U.S. PATENT DOCUMENTS

| | | | |
|---|---|---|---|
| 3,890,951 | 6/1975 | Jennings et al. | 124/44.5 |
| 4,662,346 | 5/1987 | Laffin | 124/44.5 |
| 4,759,337 | 7/1988 | Suski | 124/24.1 |
| 5,013,797 | 4/1992 | Newbold | 124/44.5 |
| 5,025,773 | 6/1991 | Hintze et al. | 124/44.5 |
| 5,031,601 | 7/1991 | Gunter | 124/44.5 |
| 5,042,450 | 8/1991 | Jacobson | 124/44.5 |
| 5,052,364 | 10/1991 | Martin et al. | 124/44.5 |
| 5,085,201 | 2/1992 | Tepper et al. | 124/44.5 |
| 5,137,006 | 8/1992 | Gallops | 124/44.5 |
| 5,245,980 | 9/1993 | Colvin | 124/24.1 |
| 5,251,606 | 10/1993 | Colvin | 124/44.5 |
| 5,261,383 | 11/1993 | Halamay | 124/44.5 |

*Primary Examiner*—John A. Ricci
*Attorney, Agent, or Firm*—Salter & Michaelson

[57] ABSTRACT

A three-point arrow rest includes a yoke, upper and lower apertures extending through the yoke, and upper and lower parallel pivot shafts which respectively extend through the apertures. The lower pivot shaft includes first and second parallel support arms, each of which includes a support ball at a terminal end thereof. The support balls are positioned in closely spaced adjacent relation so they cooperate to receive and support an arrow shaft therebetween. The upper pivot shaft includes a guide arm which includes a guide ball at a terminal end thereof. The guide ball is positioned above and between the support balls so as to form a triangle with the support balls. The arrow rest further includes a cam and spring arrangement on each of the upper and lower pivot shafts for respectively biasing the support balls upwardly to a launching position and the guide ball downwardly to a guide position. The arrow rest still further includes a cam and screw arrangement on each of the upper and lower pivot shafts for respectively adjusting the vertical launching position of the support balls and the vertical guide position of the guide ball. The yoke is mounted onto the handle portion of a bow so that the support balls and the guide ball are generally positioned to receive and support a nocked arrow.

17 Claims, 5 Drawing Sheets

ADJUSTABLE THREE-POINT ARROW REST FOR A COMPOUND ARCHERY BOW

BACKGROUND OF THE INVENTION

The instant invention relates to archery bows and more particularly to an adjustable three-point arrow rest for a compound archery bow.

Compound archery bows for use in hunting and target shooting have heretofore been known in the art. A compound archery bow normally comprises a handle portion, two arms which extend outwardly from the handle portion, two cam wheels respectively positioned at the outer ends of the arms, and a bow string which is tensioned between the cam wheels. The handle of the bow normally includes an arrow shelf upon which the shaft of the arrow is rested when drawing and releasing the arrow. In this regard, several problems have long been associated with conventional arrow rests. For example, when the arrow rest is simply formed as a shelf on the handle portion, there is no means for holding the arrow on the shelf. Accordingly, an arrow cannot be maintained on the rest while moving about, since it would easily fall off the shelf. Therefore, a hunter must select and load an arrow each time it is desired to shoot. Also, if the arrow is not drawn or released smoothly, the arrow can fall off the shelf prior to or during release. Still further, an arrow running across a shelf tends to encounter friction with the shelf, and with the handle of the bow, thereby decreasing accuracy and distance. More specifically, the arrow shaft runs along the shelf during release, thereby slowing down the velocity, and the outwardly extending fletching tends to brush the handle portion thereby imparting lateral forces to the arrow shaft and moving the arrow off of its intended flight path. A plurality of heretofore known arrow rests have attempted to resolve these problems. In this connection, the U.S. Pat. Nos. 5,042,450, to Jacobson; 5,025,773, to Hintze; and 3,890,951 to Jennings, represent the closest prior art to the invention of which the applicant is aware.

The patent to Jacobson discloses an arrow rest comprising an arrow support and a spring-biased plunger assembly. The arrow support and plunger cooperate to form a two point rest upon which the arrow rests. The arrow rest may further include an arrow guide which engages a top side of the arrow in order to securely hold the arrow within the arrow rest. While it can be seen that the plunger point is spring-biased, the upper and lower rest points are not. The Patent to Hintze et al discloses an arrow support comprising a mounting member and a yoke which is pivotably mounted to the mounting member. The yoke defines an opening having a pair of pedestals which extend radially upwardly into the opening for supporting an arrow thereon. A resilient retaining member extends radially downward into the opening to limit lateral movement of the arrow during draw and release. It is pointed out that only the upper guide point is spring-biased and that the two support pedestals are rigid. The Patent to Jennings, et al discloses an arrow support comprising an annular frame member having three resilient finger members which extend radially inward from the annular frame. The arrow is inserted through the annular frame and is supported by the resilient fingers. While all three finger provide resilient support, and the fingers are circumferentially adjustable, the upward and downward launching positions of the fingers are not adjustable.

SUMMARY OF THE INVENTION

The instant invention provides a three-point arrow rest including three spring-biased launching balls which are fully adjustable for both position and spring tension. A first embodiment of the instant arrow rest is operable for use with arrows having a downwardly facing cock fletching. The first embodiment of the arrow rest includes a yoke, upper and lower apertures extending through said yoke, and upper and lower parallel pivot shafts which respectively extend through said apertures. The lower pivot shaft includes first and second parallel support arms and each of the support arms includes a support ball at a terminal end thereof. The support balls are positioned in closely spaced adjacent relation so that they cooperate to receive and support an arrow shaft therebetween. The upper pivot shaft includes a guide arm which has a guide ball mounted at a terminal end thereof. The guide ball is positioned above and between the support balls so as to form a triangle with the support balls. The arrow rest further includes a cam and spring arrangement on each of the upper and lower pivot shafts for respectively biasing the support balls upwardly to a launching position and the guide ball downwardly to a guide position. The arrow rest still further includes a cam and screw arrangement on each of the upper and lower pivot shafts for respectively adjusting the vertical position of the support balls and the vertical position of the guide ball. The yoke is mounted onto the handle portion of a bow so that the support balls and the guide ball are generally positioned to receive and support a nocked arrow.

A second embodiment of the arrow rest is operable for use with arrows having an outwardly facing cock-fletching. The second embodiment comprises a cushion plunger which is mounted on the yoke and further comprises upper and lower parallel pivot shafts. The lower pivot shaft includes a single support arm having a support ball mounted thereon and the upper pivot shaft includes a guide arm having a guide ball mounted thereon. The support arm and the cushion plunger cooperate to form a rest for the arrow shaft and the guide arm effectively holds the arrow shaft in position during draw and release. The pivot shafts include the same two cam assemblies as the first embodiment for adjusting the spring tensions of the pivot shafts, and the vertical positions of the support and guide balls. Both embodiments of the arrow rest are reversible for use by either right or left hand shooters. The adjustability of the contact points allows the arrow rests to accomodate all arrow diameters.

Accordingly, it is an object of the instant invention to provide a three-point arrow rest wherein all three points of contact are spring biased.

It is another object to provide a three-point arrow rest in which the positions of all three-points of contact are adjustable.

It is yet another object to provide a three-point arrow rest which is adaptable for use with arrow having either outwardly facing or downwardly facing cock fletching.

It is still another object to provide a three-point arrow rest which is adaptable for either right or left hand shooters.

It is even further another object to provide an arrow rest which is capable of accomodating all arrow diameters.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
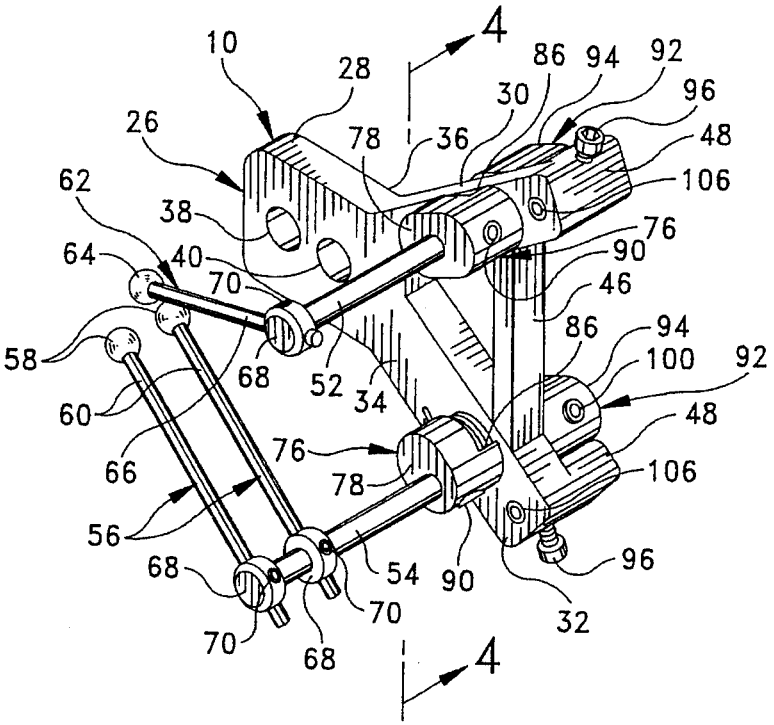
FIG. 1 is a perspective view of the adjustable three-point arrow rest of the instant invention.

Referring now to the drawings, a first embodiment of the instant three-point arrow rest is illustrated and generally indicated at 10 in FIGS. 1–6. As will hereinafter be more fully described, the instant arrow rest 10 is operative for use with a conventional compound archery bow generally indicated at 12, for supporting and guiding a nocked arrow generally indicated at 14, during draw and release. The bow 12 comprises a handle 16, two spring arms 18 which extend outwardly from the handle 16, upper and lower cam wheels 20 which are respectively mounted at the upper and lower ends of the spring arms 18 and which have cables 21 extending therearound and a bow string 22 which is tensioned between the cam wheels 20. The first embodiment of the arrow rest 10 is operable for use with an arrow 14 having a downwardly facing cock-fletching 24 (See FIGS. 2 and 6). The arrow rest 10 comprises a Y-shaped yoke generally indicated at 26 having a body 28, upper and lower rearwardly extending arms 30 and 32 respectively, and first and second opposing sides 34 and 26 respectively. The yoke 26 is preferably formed from a rigid nylon resin so that it is lightweight, yet strong and durable. The yoke 26 includes two adjacent mounting apertures 38 and 40 respectively which are formed in the body 28, and further includes upper and lower mounting apertures 42 and 44 respectively, (See FIGS. 3 and 6) which are formed in the upper and lower arms 30 and 32. The yoke 26 still further includes a crossbar 46 which operates to stabilize the upper and lower arms 30 and 32 relative to each other. The upper and lower arms 30 and 32 each include a generally rectangular appendage 48 which extends outwardly from the second side 36 thereof. The arrow rest 10 further includes two annular, self-lubricating glass-filled NYLATRON® bushings 50 which are slidably received into the upper and lower mounting apertures 42 and 44. The arrow rest 10 still further includes upper and lower parallel pivot shafts 52 and 54 respectively, which are rotatably received inside the annular bushings 50. The pivot shafts are preferably formed from steel, and in this connection, the bushings 50 provide a long-lasting, low friction bearing surface for the pivot shafts 52 and 54. The lower pivot shaft 54 includes two parallel support arms generally indicated at 56 which extend outwardly and upwardly therefrom, and each of the support arms 56 includes a rounded support ball 58 which is threadedly mounted at the terminal end of its shaft 60. The support balls 58 are positioned in closely spaced adjacent relation so that they cooperate to receive and support the arrow shaft therebetween. (See FIG. 6). The upper pivot shaft 52 includes a guide arm generally indicated at 62 which extends outwardly and downwardly therefrom, and the guide arm 62 includes a guide ball 64 which is threadedly mounted at the terminal end of the shaft 66. The guide ball 64 is positioned above and between the two support balls 58 so as to form a triangle therewith. (See FIG. 6). The guide ball 64 serves to hold the arrow shaft 14 on top of the support balls 58 and to guide the arrow shaft 14 during draw and release. The shafts 60 and 66 respectively, of the support arms 56 and the guide arm 62, are slidably received through diametrical apertures which are formed in enlarged radial disc portions 68 of their respective pivot shafts 52 and 54. The support arms 56 and the guide arm 62 are fixed in position by means of set screws 70 which radially extend through the enlarged discs 68 and engage the respective support arm 56 or guide arm 62. It can thus be seen that the support arms 56 and the guide arm 62 are longitudinally adjustable with respect to their respective pivot shafts 52 and 54. It can also be seen that the support balls 58 and the guide ball 64 are pivotable in the direction of arrows 74 for upward and downward rotational movement about their respective pivot shaft 52 and 54. (See FIG. 5).

Figure 3:
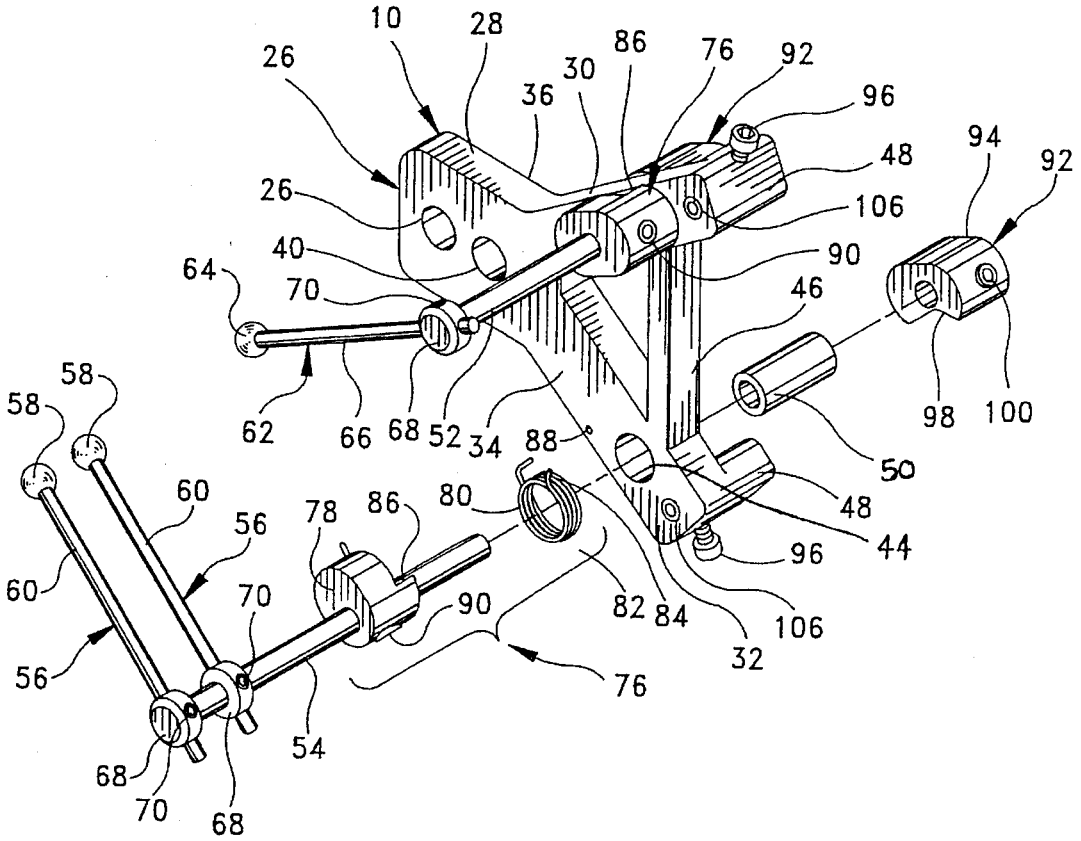
FIG. 3 is an exploded perspective view of the arrow rest illustrated in FIG. 1.

The upper and lower pivot shafts 52 and 54 each include a cam and spring mechanism generally indicated at 76, for rotatably biasing the pivot shafts in an upward or downward direction. In this connection, the lower pivot shaft 54 is rotatably biased for upward movement of the support balls 58 to a respective launching position, and the upper pivot shaft 52 is rotatably biased for downward movement of the guide ball 64 to a respective guide position. The cam and spring mechanisms 76 are essentially identical except with regard to their relative rotational positions on their respective pivot shaft 52 and 54. Each of the mechanisms 76 comprises an oval cam 78 which is eccentrically mounted on its respective pivot shaft adjacent the first side 34 of the yoke 26, and a coil spring 80 having a first end 82 which is fixedly attached to the yoke 26 and a second end 84 which is fixedly attached to a bearing surface of the cam 78. (FIG. 3). Each cam includes a curved bearing wall 86 which faces the first side 34 of the yoke 26. The first end 82 of each spring 80 comprises a finger which is bent outwardly and received into a small aperture 88 (FIG. 3 only one shown) formed in the yoke 26. The second end 84 of each spring 80 comprises a bent finger which engages with an edge of the curved bearing wall 86 of the cam 78. The cams 78 are fixedly positioned on their respective pivot shaft by means of a set screw 90 which extends through the cam 78 and engages with the pivot shaft. In this regard, it can be seen that the tension level of the spring 80, and hence the upward or downward bias of the support balls 58 and guide ball 64 may be adjusted by rotating the cam 78 with respect to the pivot shafts in the direction of arrow 91 (FIG. 4) in order to tighten or loosen the coil of the spring 80.

The upper and lower pivot shafts 52 and 54 each further include a second cam mechanism generally indicated at 92 which is operative for adjusting the respective launching position of the support balls 58 and the guide position of the guide ball 64. The second cam mechanisms 92 are also essentially identical, except with regard to their relative rotational position. Each of the cam mechanisms 92 comprises a generally oval cam 94 which is eccentrically mounted on its respective pivot shaft adjacent the second side 36 of the yoke 26, and a threaded adjustment screw 96.

Each cam 94 includes a flat bearing surface 98, and the cams 94 are received onto their respective pivot shafts so that the flat bearing surfaces 98 faces the adjacent rectangular appendages 48. The threaded adjustment screws 96 threadedly extend through the appendages 48 so as to engage with the flat bearing surfaces 98 of the cams 94. The cams 94 are fixed in their respective rotational positions by means of set screws 100 which extend through the cams 94 and engage with the respective pivot shaft. It can thus be seen that threaded movement of the adjustment screws 96 in the directions of arrows 102 (FIG. 5) cause a corresponding rotational movements of the cams 94 and respective pivot shafts in the direction of arrows 104 thereby adjusting the launching positions of the support balls 58 upwardly or downwardly and/or adjusting the guide position of the guide ball 64 upwardly or downwardly. It is further pointed out that the threaded adjustment screws 96 are held in position by set screws 106 which extend through the respective arms 30 and 32 and engage with the shaft of the adjustment screws 96.

It is still further pointed out that cams 78 and 94 fit closely against both ends of bushings 50 and that the springs 80 wrap around the bushings 50. This particular construction allows the pivot shafts to function with minimal longitudinal movement.

Figure 2:
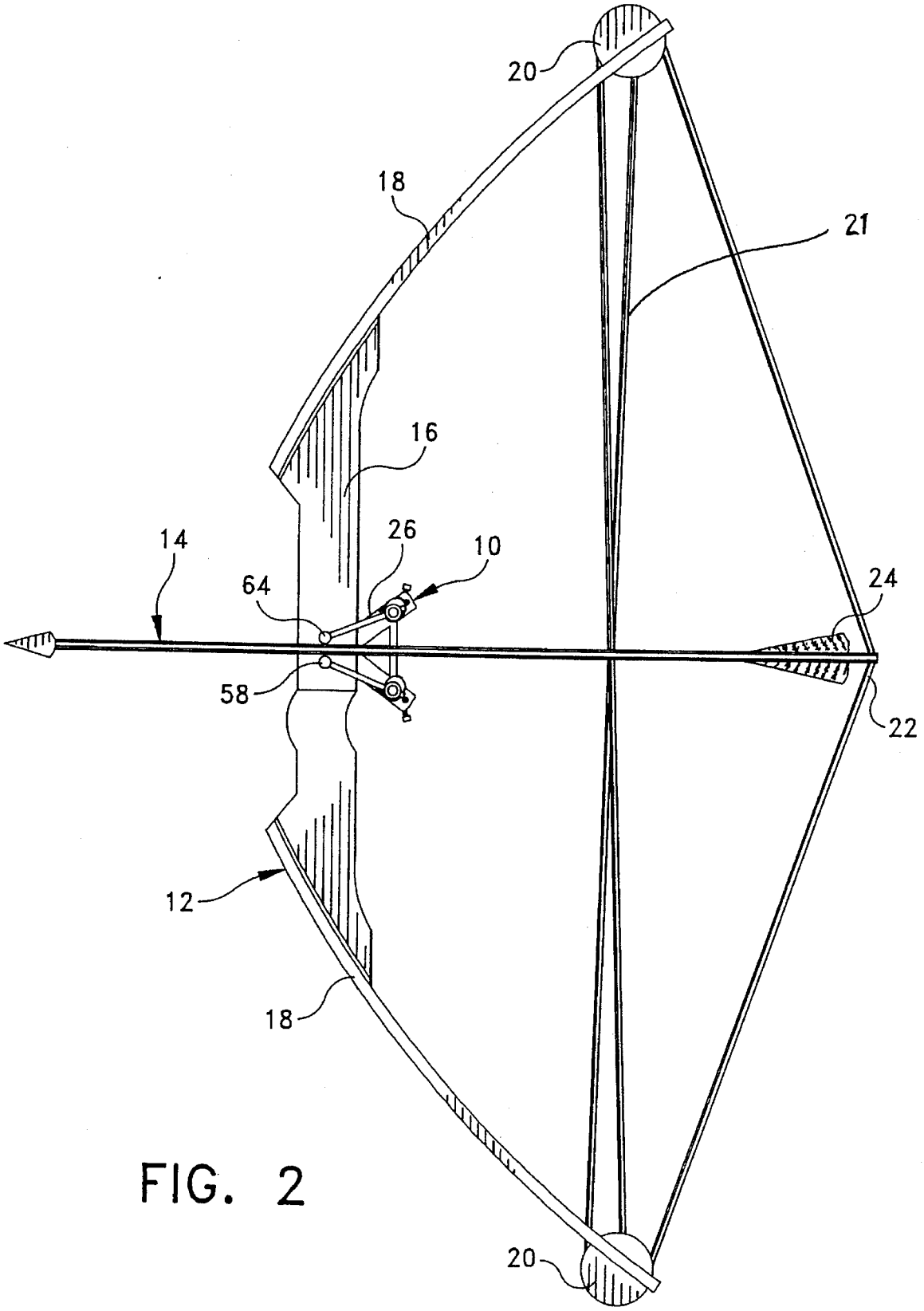
FIG. 2 is a side view of a compound archery bow with the instant arrow rest mounted on the handle portion thereof.
Figure 4:
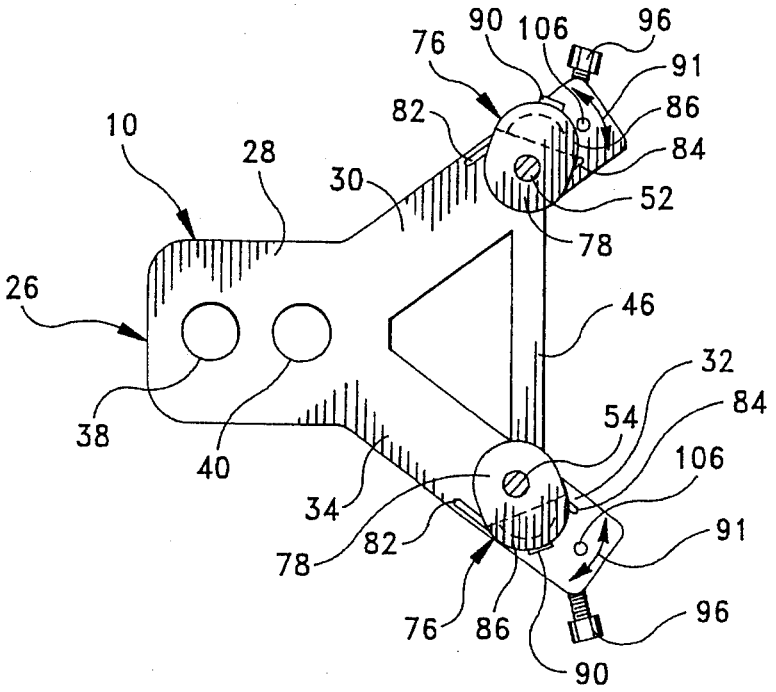
FIG. 4 is a sectional view thereof taken along line 4—4 of FIG. 1.
Figure 5:
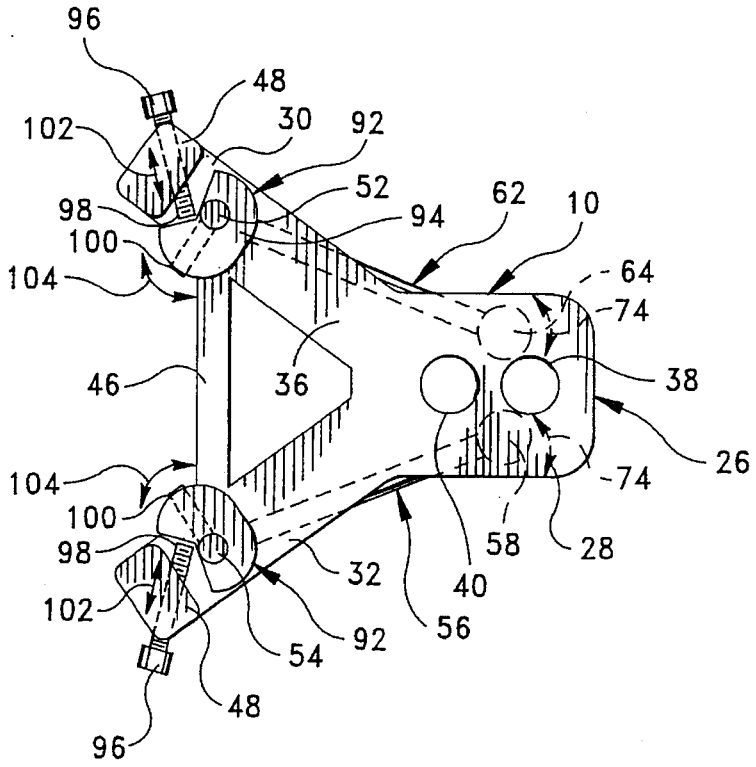
FIG. 5 is a side view thereof.
Figure 6:
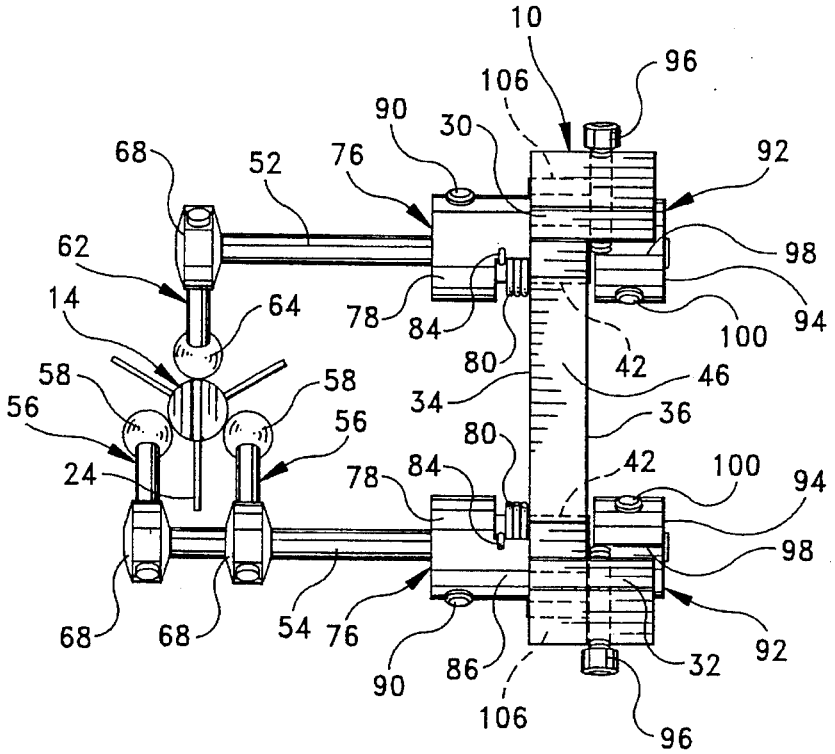
FIG. 6 is a rear view thereof with an arrow shown in the mounted position thereon.

The yoke 26 is mounted onto the handle portion 16 of a compound archery bow 12 so that the support balls 58 and the guide ball 64 are generally positioned to receive and support a nocked arrow 14. (FIG. 2). It is pointed out that the yoke 26 is mounted to the handle 16 by extending a mounting bolt (not shown) through one of the mounting apertures 38 or 40 in the body 28, and into a corresponding threaded aperture (not shown) in the handle 16 of the bow 12.

Figure 7:
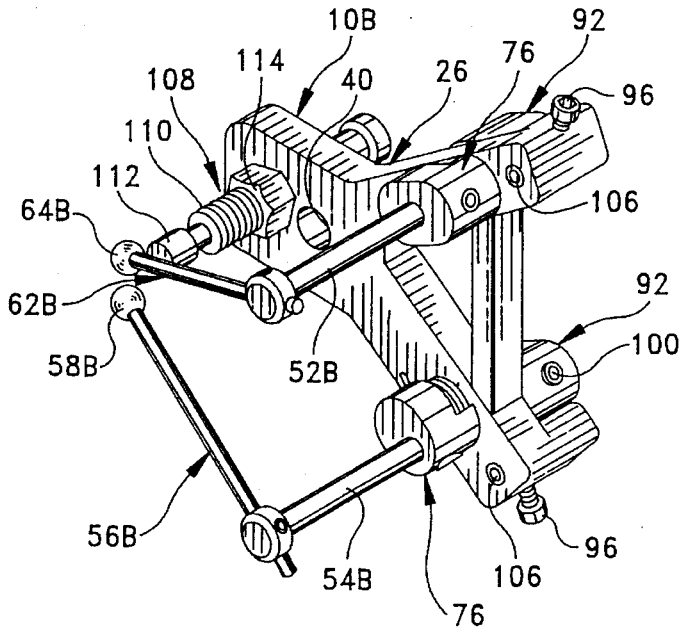
FIG. 7 is a perspective view of a second embodiment of the instant arrow rest.
Figure 8:
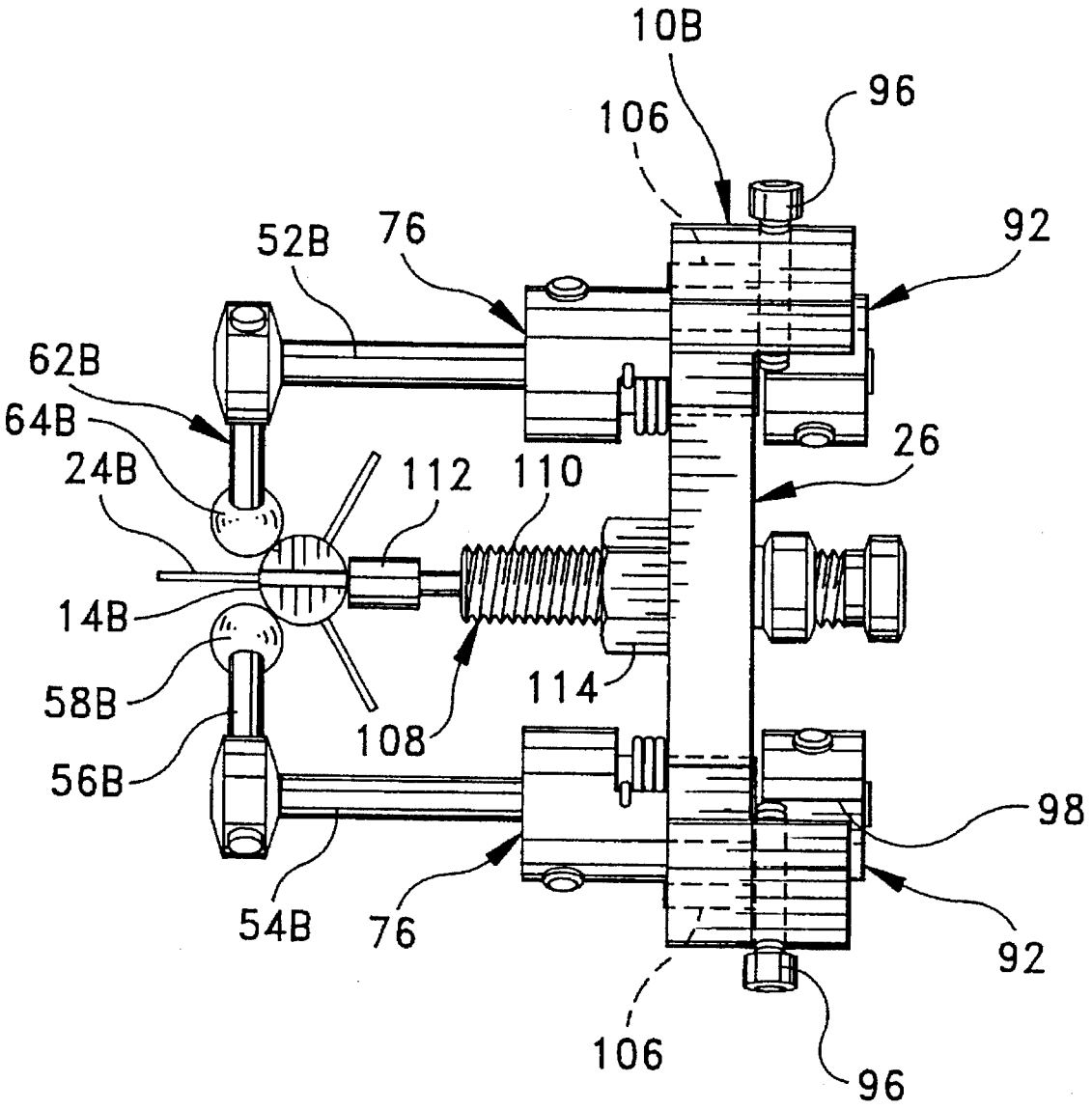
FIG. 8 is a rear view thereof with an arrow shown in the mounted position thereon.

A second embodiment of the arrow rest is illustrated and generally indicated at 10B in FIGS. 7 and 8. As will hereafter be more fully described, the arrow rest 10B is operative for use with arrows 14B having outwardly facing cock-fletching 24B. (FIG. 8). The arrow rest 10B comprises a yoke 26, a spring-biased cushion plunger generally indicated at 108, and upper and lower pivot shafts 52B and 54B. The cushion plunger 108 is well known in the compound bow art, and it comprises a threaded shaft 110, and a spring biased plunger 112 which is axially mounted in the threaded shaft 110. The cushion plunger is received through one of the mounting apertures 38 or 40 in the yoke 26 and secured in position by a threaded bolt 114. The lower pivot shaft 54B includes a support arm 56B which extends radially outwardly and upwardly from the lower pivot shaft 54B, and the support arm 54B includes a support ball 58B which is threadedly mounted at a terminal end thereof. The support ball 58B is positioned in closely spaced adjacent relation to the cushion plunger 112 so that the support ball 58B and the cushion plunger 112 cooperate to receive and support an arrow shaft 14B thereon. The upper pivot shaft 52B includes a guide arm 62B which extends radially outwardly and downwardly from the upper pivot shaft 52B and the guide arm 62B includes a guide ball 64B at a terminal end thereof. The guide ball 64B is positioned directly above the support ball 58B so as to form a triangle with the cushion plunger 112 and the support ball 58B. (See FIG. 8). The support arm 56B and guide arm 62B are longitudinally adjustable as described previously with regard to the first embodiment, and the upper and lower pivot shafts 52B and 54B each includes the cam assemblies 76 and 92 in order to rotatably bias the pivot shafts 52B and 54B, and to adjust the vertical positions of the support ball 58B and guide ball 64B. The yoke 26 is mounted onto the bow handle 16 in the same manner as described previously, with the exception that threaded shaft 110 of the cushion plunger extends through the mounting hole (not shown) in the bow handle 16 and acts as the mounting bolt.

It is pointed out that the support balls 58 and the guide ball 64 may comprise either a hard metal alloy or a synthetic plastic material. The hard metal alloy provides a hard, long wearing surface for practice, however it also make an audible scraping noise against the outside surface of the arrow shaft which is undesirable during hunting. The plastic balls wear more quickly, however they produce no audible sounds which will alert the animal being hunted. Accordingly, it can be seen that metal allow balls are preferable for practice, and plastic balls are preferable for hunting.

While the arrow rests 10 and 10B are illustrated and described for use by a right-handed shooter, it is to be understood that the arrow rests 10 and 10B may be easily reversed for use by a left-handed shooter. To reverse the first embodiment for left hand use, the yoke 26 is mounted on the opposite side of the bow handle 16 and the upper and lower pivot shafts 52 and 54 are reversed so that the support arm or arms 56 face upwardly in the left-hand mode. To reverse the second embodiment, the yoke is simply mounted on the opposite side of the bow handle. There is no need to reverse the pivot shafts since they are simply reversed in position. The arrow rests 10 and 10B function identically in both the left hand and right hand modes.

It can therefore be seen that the instant invention provides an arrow rest 10 in which all three contact points are spring biased and fully adjustable. The three rounded contact points of the instant invention produce relatively little friction with the arrow shaft 14 and therefore do not reduce the velocity of the arrow 14 when released. Still further, the three-point arrow rest 10 does not interfere with the fletching 24 of the arrow 14 and therefore does not impart lateral forces which may force the arrow 14 off its intended flight path. The support arms 56 and guide arm 62 of the arrow rest 10 are longitudinally adjustable, the support balls 58 and guide ball 64 are rotatably adjustable in upward and downward direction, and the spring tension of the pivot shafts 52 and 54 is adjustable. The adjustability of the three contact points enables the arrow rest to accomodate all arrow diameters. The arrow rest 10 is also reversible for use by both right hand and left hand shooters. A second embodiment 10B of the arrow rest is operative for arrows with outwardly facing cock-fletching. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A three-point arrow rest for an archery bow comprising:

a yoke having spaced upper and lower apertures therein;

upper and lower pivot shafts which are respectively rotatably mounted in said upper and lower apertures;

first and second parallel support arms which extend outwardly and upwardly from said lower pivot shaft, each of said support arms including a support ball at a terminal end thereof, said support balls being positioned in closely spaced adjacent relation so as to receive and support an arrow shaft therebetween;

means for biasing said support balls upwardly to a launching position;

a guide arm which extends outwardly and downwardly from said upper pivot shaft, said guide arm including a guide ball at a terminal end thereof, said guide ball being positioned above and between said support balls so as to generally form a triangle therewith;

means for biasing said guide ball downwardly to a guide position; and means for mounting said yoke to a handle portion of said bow so that said support balls and said guide ball are generally positioned to receive and support a nocked arrow.

2. The arrow rest of claim 1 further comprising upper and lower bushings which respectively axially extend through said upper and lower apertures, said upper and lower pivot shafts extending axially through said bushings.

3. In the arrow rest of claim 2, said bushings comprising self-lubricating bushings.

4. In the arrow rest of claim 1, said means for biasing said support balls upwardly comprising a cam mounted on said lower pivot shaft adjacent said yoke, and a spring having a first end fixedly mounted to said yoke and a second end fixedly mounted to said cam, said spring being operable for rotatably biasing said lower pivot shaft for upward movement of said support balls.

5. In the arrow rest of claim 4, said cam being rotatably adjustable with respect to said lower pivot shaft for adjusting a bias level of said spring.

6. In the arrow rest of claim 1, said means for biasing said guide ball downwardly comprising a cam mounted on said upper pivot shaft adjacent said yoke, and a spring having first end fixedly mounted to said yoke and a second end fixedly mounted to said cam, said spring being operable for rotatably biasing said upper pivot shaft for downward movement of said guide ball.

7. In the arrow rest of claim 6, said cam being rotatably adjustable with respect to said upper pivot shaft for adjusting a bias level of said spring.

8. The arrow rest of claim 1 further comprising means for adjusting said launching position of said support balls.

9. In the arrow rest of claim 8, said means for adjusting said launching position comprising a cam fixedly mounted on said lower pivot shaft adjacent said yoke, and a threaded adjustment screw, said cam including a flat bearing surface, said adjustment screw threadedly extending through said yoke so that a terminal end thereof engages with said flat bearing surface of said cam, wherein rotation of said adjustment screw causes corresponding rotation of said cam and said lower pivot shaft for upward or downward movement of said support balls.

10. The arrow rest of claim 1 further comprising means for adjusting said guide position of said guide ball.

11. In the arrow rest of claim 10, said means for adjusting said guide position comprising a cam fixedly mounted on said upper pivot shaft adjacent said yoke, and a threaded adjustment screw, said cam including a flat bearing surface, said adjustment screw threadedly extending through said yoke so that a terminal end thereof engages with said flat bearing surface of said cam, wherein rotation of said adjustment screw causes corresponding rotation of said cam and said upper pivot shaft for upward or downward movement of said guide ball.

12. In the arrow rest of claim 1, said support arms and said guide arm being longitudinally adjustable with respect to said respective upper and lower pivot shafts.

13. In the arrow rest of claim 1, said support balls and said guide ball being respectively releasably mounted to said support arms and said guide arm.

14. In the arrow rest of claim 1, said support balls being respectively threadedly mounted to said support arms and said guide arm.

15. A three-point arrow rest for an archery bow comprising:

a yoke having first and second opposing sides and spaced upper and lower apertures therein;

upper and lower pivot shafts which are respectively rotatably mounted in said upper and lower apertures;

first and second parallel support arms which extend outwardly and upwardly from said lower pivot shaft, each of said support arms including a support ball at a terminal end thereof, said support balls being positioned in closely spaced adjacent relation so as to receive and support an arrow shaft thereon;

a first cam mounted on said lower pivot shaft adjacent said first side of said yoke, and a spring having a first end fixedly mounted to said yoke and a second end fixedly mounted to said first cam, said spring being operable for rotatably biasing said lower pivot shaft for upward movement of said support balls;

a guide arm which extends outwardly and downwardly from said upper pivot shaft, said guide arm including a guide ball at a terminal end thereof, said guide ball being positioned above and between said support balls so as to form a triangle therewith;

a second cam mounted on said upper pivot shaft adjacent said first side of said yoke, and a spring having first end fixedly mounted to said yoke and a second end fixedly mounted to said second cam, said spring being operable for rotatably biasing said upper pivot shaft for downward movement of said guide ball; and means for mounting said yoke to a handle portion of said bow so that said support balls and said guide ball are generally positioned to receive and support a nocked arrow.

16. The arrow rest of claim 15 further comprising:

a third cam fixedly mounted on said lower pivot shaft adjacent said second side of said yoke, and a threaded adjustment screw, said third cam including a flat bearing surface, said adjustment screw threadedly extending through said yoke so that a terminal end thereof engages with said flat bearing surface of said third cam, wherein rotation of said adjustment screw causes corresponding rotation of said third cam and said lower pivot shaft for upward or downward adjustment of said launching position; and a fourth cam fixedly mounted on said upper pivot shaft adjacent said second side of said yoke, and a threaded adjustment screw, said fourth cam including a flat bearing surface, said adjustment screw threadedly extending through said yoke so that a terminal end thereof engages with said flat bearing surface of said fourth cam, wherein rotation of said adjustment screw causes corresponding rotation of said fourth cam and said upper pivot shaft for upward or downward movement of said guide position.

17. A three-point arrow rest for an archery bow comprising:

a yoke having spaced upper and lower apertures therein;

a spring-biased cushion plunger mounted on said yoke;

upper and lower pivot shafts which are respectively rotatably mounted in said upper and lower apertures;

a support arm which extends outwardly and upwardly from said lower pivot shaft, said support arm including a support ball at a terminal end thereof, said support ball being positioned in closely spaced adjacent relation to said cushion plunger so that said support ball and said cushion plunger cooperate to form a rest which receives and supports an arrow shaft thereon;

means for biasing said support arm relative to said lower pivot shaft to position said support ball in a launching position;

a guide arm which extends outwardly and downwardly from said upper pivot shaft, said guide arm including a guide ball at a terminal end thereof, said guide ball being positioned above said support ball so as to guide said arrow on said rest formed by said support ball and said cushion plunger;

means for biasing said guide arm relative to said upper pivot shaft to position said guide ball in a guide position; and means for mounting said yoke to a handle portion of said bow so that said support ball and said guide ball are generally positioned to receive and support a nocked arrow.

* * * * *